US005785437A

United States Patent [19]

Koyama et al.

[11] Patent Number: 5,785,437

[45] Date of Patent: Jul. 28, 1998

[54] TAPE CARTRIDGE FOR COATING FILM TRANSFER TOOL AND COATING FILM TRANSFER TOOL

[75] Inventors: Kouhei Koyama, Osaka; Shigeru Tamai, Ikeda; Masatoshi Shintani, Sanda, all of Japan

[73] Assignee: Seed Rubber Company Limited, Osaka, Japan

[21] Appl. No.: 458,113

[22] Filed: Jun. 2, 1995

[30] Foreign Application Priority Data

Dec. 12, 1994 [JP] Japan ..... 6-322458

[51] Int. Cl.[6] ..... B41J 35/02

[52] U.S. Cl. ..... 400/193; 400/695; 400/696; 400/208; 156/540

[58] Field of Search ..... 400/193, 208, 400/695, 696, 208.1; 118/257; 15/3.53, 104.94, 424, 425, 433, 434; 156/577, 540, 523, 576

[56] References Cited

U.S. PATENT DOCUMENTS

| | | | |
|---|---|---|---|
| 3,889,310 | 6/1975 | Barouh et al. | 400/696 |
| 4,426,169 | 1/1984 | Hartmann | 400/241.1 |
| 4,521,471 | 6/1985 | Merrill | 428/40 |
| 4,547,088 | 10/1985 | Shattuck | 400/241.1 |
| 4,671,687 | 6/1987 | Tamai | 400/208 |
| 4,718,971 | 1/1988 | Summers | 156/540 |
| 4,826,562 | 5/1989 | Ehlis | 156/523 |
| 5,125,589 | 6/1992 | Manusch | 242/67.3 R |
| 5,310,445 | 5/1994 | Tucker | 156/574 |
| 5,346,580 | 9/1994 | Elges et al. | 156/540 |
| 5,379,477 | 1/1995 | Tamai et al. | 15/104.94 |
| 5,430,904 | 7/1995 | Ono et al. | 400/695 |
| 5,490,898 | 2/1996 | Koyama | 156/540 |
| 5,499,877 | 3/1996 | Sakanishi et al. | 400/193 |

FOREIGN PATENT DOCUMENTS

| | | | |
|---|---|---|---|
| 0672063 | 7/1979 | U.S.S.R. | 400/696 |

*Primary Examiner*—Christopher A. Bennett
*Attorney, Agent, or Firm*—Nikaido, Marmelstein, Murray & Oram LLP

[57] ABSTRACT

A tape cartridge detachably attached to a refill type coating film transfer tool that allows replacement of coating film transfer tapes, and formed in a compact size and simple structure using fewer components. The tape cartridge has a compact size and simple structure, comprising a pay-out reel with a coating film transfer tape wound thereabout and a winding reel for collecting a used tape rotatably provided in a support base in a form of a flat plate, and the reels are detachably engaged, respectively, with a pay-out rotation part and a winding rotation part rotatably provided in a case of the coating film transfer tool for integral movement therewith. In order to replace a tape cartridge, the support base is placed on the rotation parts, while the reels are in engagement with the rotation parts, respectively, then, the tape is set to a head.

21 Claims, 16 Drawing Sheets

FIG. 6(a)
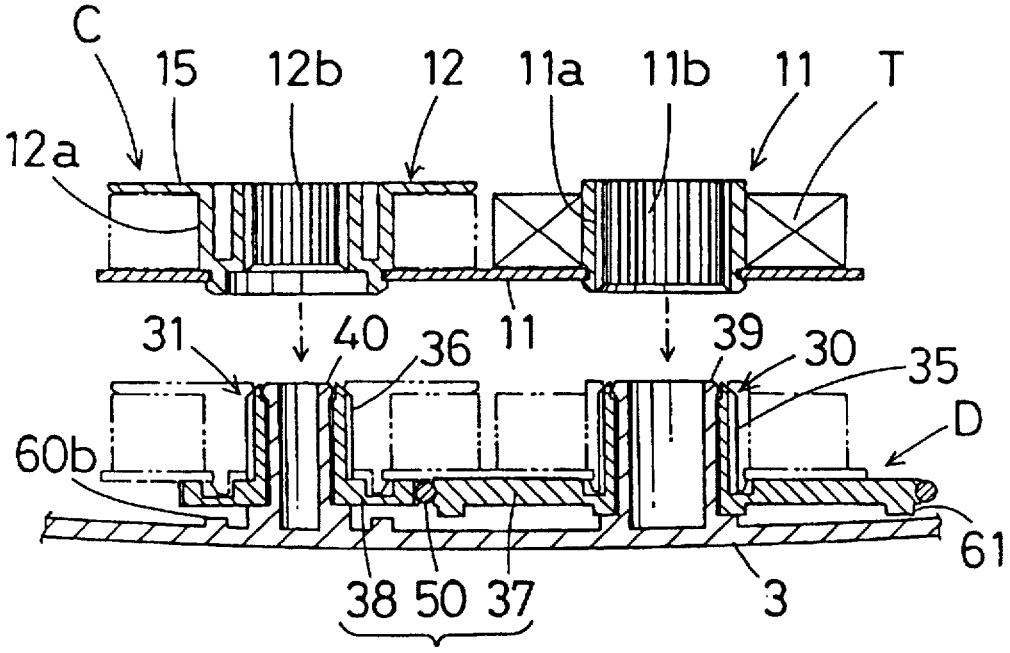
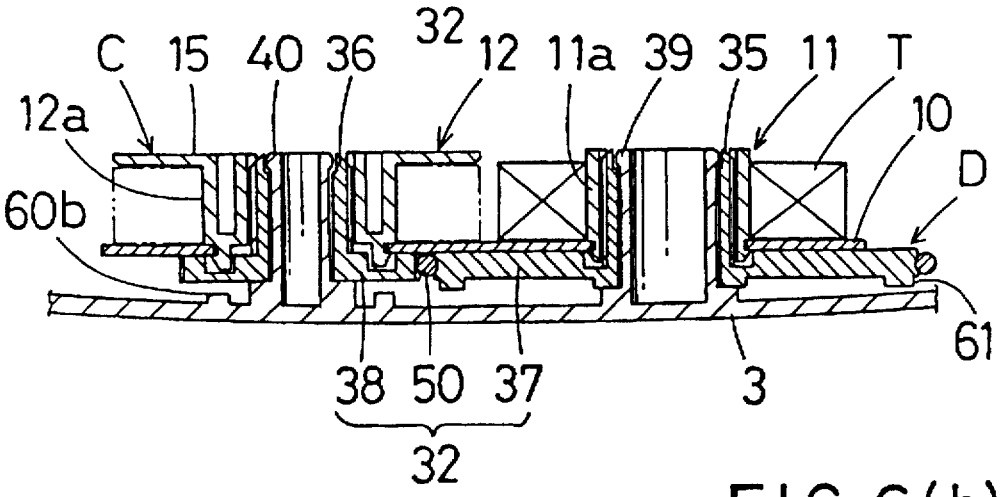
FIG. 6(b)

TAPE CARTRIDGE FOR COATING FILM TRANSFER TOOL AND COATING FILM TRANSFER TOOL

BACKGROUND OF THE INVENTION

1. Field of the Invention

The present invention relates to a tape cartridge for a coating film transfer tool and a coating film transfer tool comprising the cartridge, and more particularly to a refill type coating film transfer tool allowing replacement of coating film transfer tapes for transferring such a coating film, as a corrective paint layer and an adhesive layer on the coating film transfer tape, to a sheet surface and the like.

2. Description of the Related Art

As examples of a conventional coating film transfer tool, the inventors have already proposed a coating film transfer tool disclosed in Japanese Laid-open Patent No. 5-138097 and Japanese Laid-open Utility Model No. 5-13800, for example.

Both coating film transfer tools are used mainly as an erasing tool for correcting errors and the like, and as shown in FIGS. 16 (*a*) and 16 (*b*) a pay-out reel (c) with a coating film transfer tape (b) wound thereabout and a winding reel (d) for collecting the coating film transfer tape (b) after use are provided rotatably in a case (a) that is held by hand for operation thereof. In a leading end of the case (a), a coating film transfer head (f) is provided projectingly for pressing the coating film transfer tape (b) onto a transfer area (correction area on a sheet surface) (e). The coating film transfer tape (b) paid out from the pay-out reel (c) is arranged such that it is dragged through a pressing part (g) of a leading end of the head (f) and windingly taken up about the winding reel (d).

In such a case, the case (a) is a geometrically depressed box which is dimensionally sufficient for containing the pay-out reel (c) and winding reel (d). Flat front and back surfaces of the case (a), that is, front and back surfaces with respect to the sheet surface (e) of FIGS. 16 (*a*) and (*b*), provide gripping surfaces for manually operating the tool.

In a coating film transfer tool shown in FIG. 16 (*a*), the pressing part (g) of the leading end of the head (f) is arranged such that the coating film transfer tape (b) is guided as it is wound about the pay-out reel (c) and winding reel (d), and the tool is constructed for allowing so-called vertical pulling use that is suitable for correcting, for example, a part of a sentence that is written in a vertical line, such as Japanese and the like. On the other hand, in a coating film transfer tool shown in FIG. 16(*b*), the pressing part (g) of head (f) is arranged such that the coating film transfer tape (b) is guided generally facing against the gripping surface of the case (a), and the tool is constructed for allowing so-called lateral pulling use that is suitable for correcting, for example, a part of a sentence that is written in a lateral line such as English and the like.

Then, in order to erase an error by using the coating film transfer tools, the gripping surfaces of the case (a) are held by fingers, and the case (a) is moved in the specified direction (shown by an arrow in FIG. 16 (*a*) or vertical to the sheet surface in FIG. 16 (*b*)), respectively, while the coating film transfer tape (b) is tightly pressed against the correction area (e) of the sheet surface. In such a manner, a corrective paint layer coated on the coating film transfer tape (b) in the pressing part (g) of the head (f) is applied onto the correction area (e), a letter or the like in the area is thereby erased, and the used coating film transfer tape (b) is collected by the winding reel (d).

Incidentally, effective use of earth resources has been particularly emphasized in these days, and it is desirable in a coating film transfer tool of this invention to have a so-called refillable type structure for allowing replacement of the coating film transfer tape (b) that is only partly consumed because saving of natural resources is demanded.

In this respect, in a coating film transfer tool of the vertical pulling type shown in FIG. 16 (*a*), various tape cartridges replaceably employed in the case (a) are proposed. Such tape cartridges provided as a consumable supply can be generally classified as structures composed of a combination of four components in total, that is, the coating film transfer tape (b), the pay-out reel (c), winding reel (d) and head (f), or a combination of three components in total, that is the coating film transfer tape (b), pay-out reel (c), and winding reel (d).

In a tape cartridge of the former type, all four components (b), (c), (d) and (f) are provided in a plastic container, and, when used up, they are completely replaced by a new cartridge. On the other hand, in a tape cartridge of the latter type, the three components (b), (c) and (d) are temporarily held by a holding member which is removed during replacement of a used tape cartridge.

However, either type of the tape cartridge has the problem as described below, and further modification has been demanded.

That is, in the former, most of the main components of the coating film transfer tool are replaced as consumable items, and all such components are housed in a plastic container, therefore, many components are used, the structure thereof is complex and bulky, and the cost for manufacturing the replacement parts themselves is high. Thus, inherent advantages of the refill type, such as saving of resources and reduction of running cost, cannot be sufficiently achieved. Besides, as the plastic container itself is relatively bulky because of its structure, it causes an increase in the size of the coating film transfer tool, which is disadvantageous in regard to portability and easy operation.

In the case of the latter, because a holding member for temporarily holding the components is used, and replacement thereof is relatively complicated as well as troublesome, the user is required to be more or less familiar with the operation, and easy and proper replacement cannot be assured, therefore, to all general users.

Moreover, in the coating film transfer tool of the lateral pulling type shown in FIG. 16 (*b*), because the pressing part (g) of the head (f) guides the coating film transfer tape (b) with the tape generally facing against the gripping surface of the case (a), it has been practically impossible to provide a refill type structure for allowing replacement of the coating film transfer tape (b) only.

That is, in the coating film transfer tool, because of its structure, the coating film transfer tape (b) is necessarily twisted 90° in the head (f). Therefore, it is also difficult for a manufacturer to automatically assemble the tool. The tool is therefore actually assembled manually by skilled workers.

On the other hand, in order to provide a refill type structure for allowing replacement of the coating film transfer tape (b) that is a consumable item, it is required that disassembly of a coating film transfer tool, replacement of the coating film transfer tape (b) and reassembly of the tool be achieved by a user. Thus, it has been an essential issue to develop such a structure that the series of operations, disassembly, replacement and reassembly, can be easily, rapidly and properly conducted by a general user to allow replacement of the coating film transfer tape (b).

BRIEF SUMMARY OF THE INVENTION

It is a primary object of the invention to provide a novel tape cartridge that eliminates the conventional problems of a coating film transfer tool.

It is another object of the invention to provide a tape cartridge comprising fewer components in a small and simple structure for achieving a compact coating film transfer tool and allowing easy, rapid and proper replacement of the film (tape).

It is further object of the invention to provide a coating film transfer tool of a refill type to be used as a kind of stationery and allowing easy replacement of coating film transfer tapes.

It is a different object of the invention to provide a coating film transfer tool of such a refill type for lateral pulling use.

A tape cartridge according to the invention comprises a pay-out reel with a coating film transfer tape wound thereabout and a winding reel for collecting the coating film transfer tape after use provided rotatably on a support base in a form of a flat plate, wherein the reels are removably and integrally rotatably engaged, respectively, in a pay-out rotation part and winding-up rotation part that is provided rotatably in the case. Preferably, the support base comprises a thin plate member having sufficient strength to hold the reels with a spacing corresponding to the rotation parts, and is arranged such that one of the surfaces of the support base provides a running and guiding surface for the coating film transfer tape.

A coating film transfer tool according to the invention is constructed for removably and replaceably containing the tape cartridge in a hand-held case for operation, wherein a pay-out rotation part and a winding-up rotation part are rotatably attached to the case, respectively, the pay-out reel and take-up reel of the tape cartridge are removably placed on the rotation parts, respectively, a coating film transfer head is provided projectingly in a leading end of the case for pressing a coating film transfer tape in the tape cartridge against a transfer part, and the coating film transfer tape paid out from the pay-out reel is dragged through the pressing part at the leading end of the head, and is then wound about the winding reel. The head is rotatably operative between a coating film transfer tape replacement position and an application position as well as being fixed at an angle for vertical pulling use, and the pressing part in the leading end of the head guides the coating film transfer tape as it is wound about the pay-out reel and winding reel in the coating film replacement position and as it generally faces against gripping surfaces of the case when the case is in the application position.

Now, relative to a tape cartridge according to the invention, because the pay-out and winding reels are attached to the support base, replacement is conducted for each support base.

In such a case, replacement is completed by placing the support base on the rotation parts with the reels held in engagement with the pay-out and winding rotation parts of the coating film transfer tool, and setting a coating film transfer tape to the coating film transfer head of the case.

The support base is formed as a flat plate, and the reels are supported only by the support base for reducing the number of components, and reducing the size and simplifying the structure as well as reducing its manufacturing cost, which lead to reduction in size of the coating film transfer tool.

In addition, in a coating film transfer tool according to the invention, because the head is rotatably operative between a coating film transfer tape replacement position and an application position, the pressing part in a leading end of the head guides the coating film transfer tape as it is wound about the pay-out and winding reels in the coating film transfer tape replacement position, and as it generally faces against gripping surfaces of the case in the application position, which are two features that are conventionally unachievable. That is, lateral pulling use and replacement of coating film transfer tapes can be met simultaneously in a structure.

In other words, because the coating film transfer tape is guided by the pressing part of the head, as the tape generally faces against gripping surfaces of the case during use, the coating film transfer tape can be pressed tightly against a sheet surface or the like by means of the pressing part of the head by holding the case itself in an attitude similar to that of a writing tool, and a corrective paint layer of the coating film transfer tape is transferred to the sheet surface or the like by moving the case laterally or in the right or left direction with respect to the sheet surface or the like.

In replacement of a coating film transfer tape, firstly the head is rotated from the application position to the coating film transfer tape replacement position. In such a manner, as the coating film transfer tape in the head part is operated from a 90° twisted to parallel state, in relation to the winding attitude of the pay-out and winding reels, so that the coating film transfer tape can be easily detached with respect to the head, the tape cartridge can be replaced by opening the case in that state.

Here, such an expression that the coating film transfer tape "generally faces against gripping surfaces of the case" means that front and back surfaces of a coating film transfer tape generally face against gripping surfaces of the case, that is, the front and back surfaces of the coating film transfer tape are generally in the same direction as that of the gripping surfaces of the case or in parallel therewith, which applies throughout the specification.

The above and other objects and features of the invention will be clearly appreciated by reading a detailed description in connection with attached drawings and novel features of the invention depicted in the claims.

BRIEF DESCRIPTION OF THE DRAWINGS

FIG. 6 (*a*) and 6 (*b*) are sectional views for explaining attachment of the tape cartridge to a tape driving part.

DETAILED DESCRIPTION OF THE PREFERRED EMBODIMENT

Figure 1:
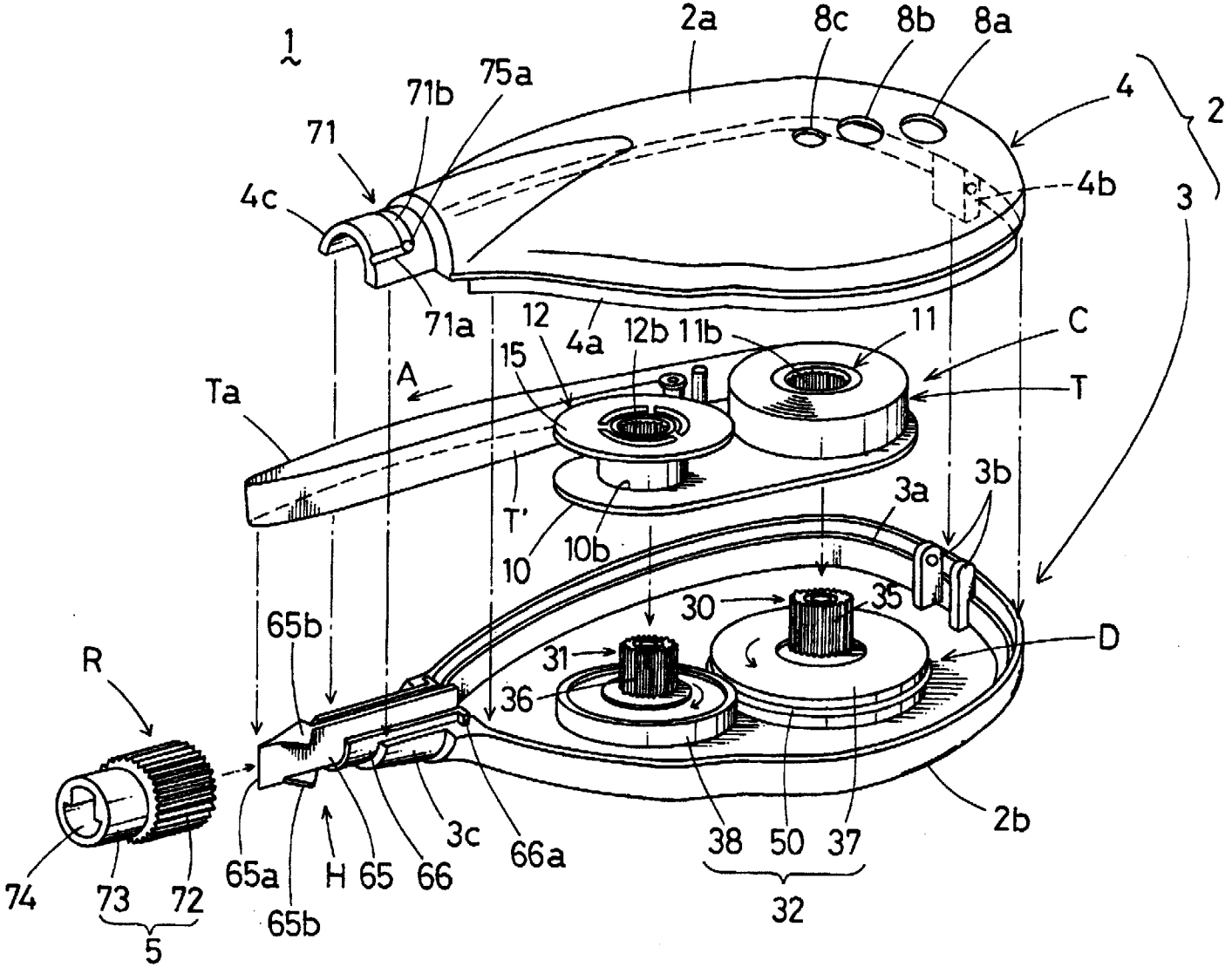
FIG. 1 is a exploded perspective view showing an erasing tool according to an embodiment of the invention.
Figure 2:
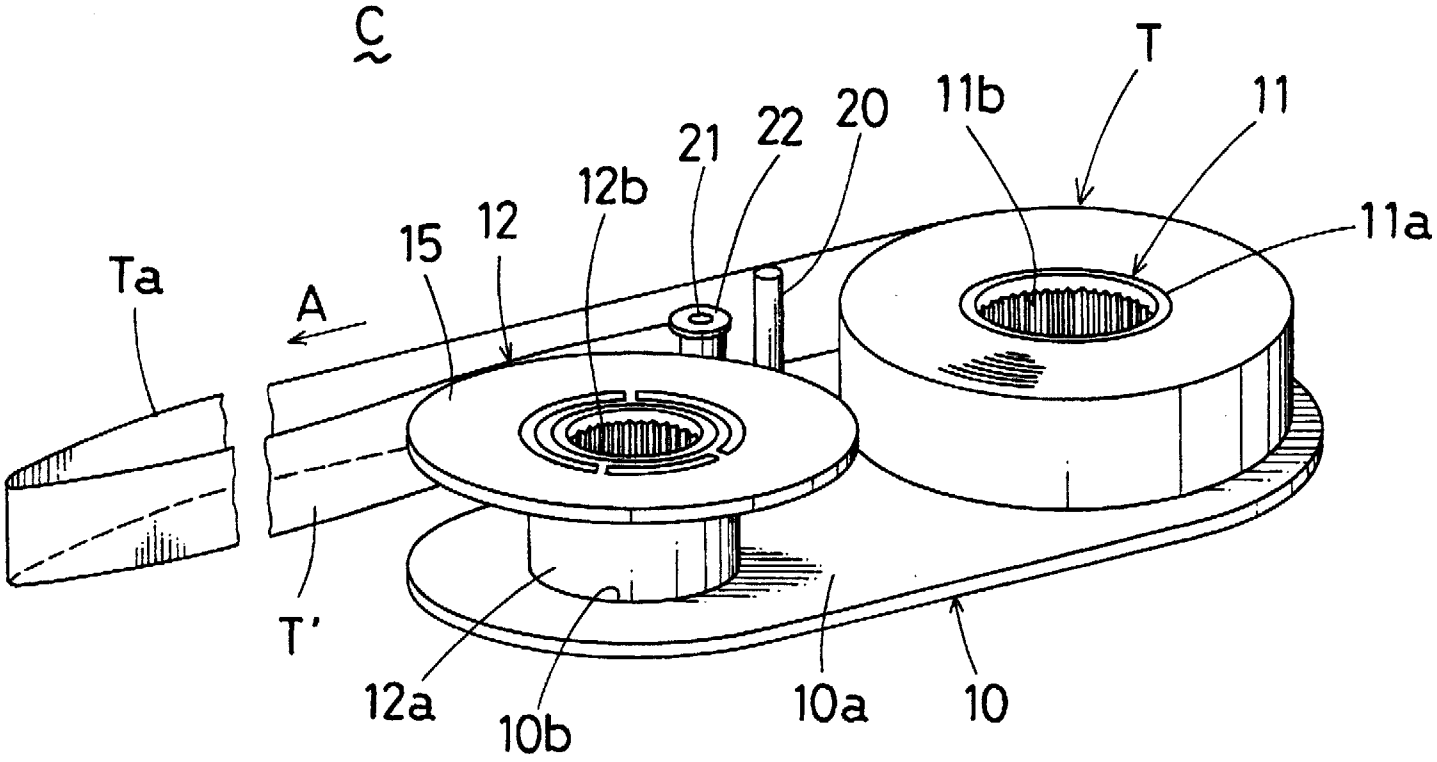
FIG. 2 is a perspective view of a tape cartridge for use with the erasing tool.

An embodiment of the invention is described below by referring to the drawings.

FIGS. 1 to 15 show tape cartridges and coating film transfer tools according to the invention, in which identical components or elements are accorded the same reference numerals throughout the drawings.

In FIGS. 1 to 14, a coating film transfer tool according to an embodiment of the invention is shown. The coating film transfer tool 1 is particularly used as an erasing tool for correcting errors or the like, and is of a cartridge type or refill type structure for allowing replacement of a coating film transfer tape T as a consumable supply.

Figure 12:
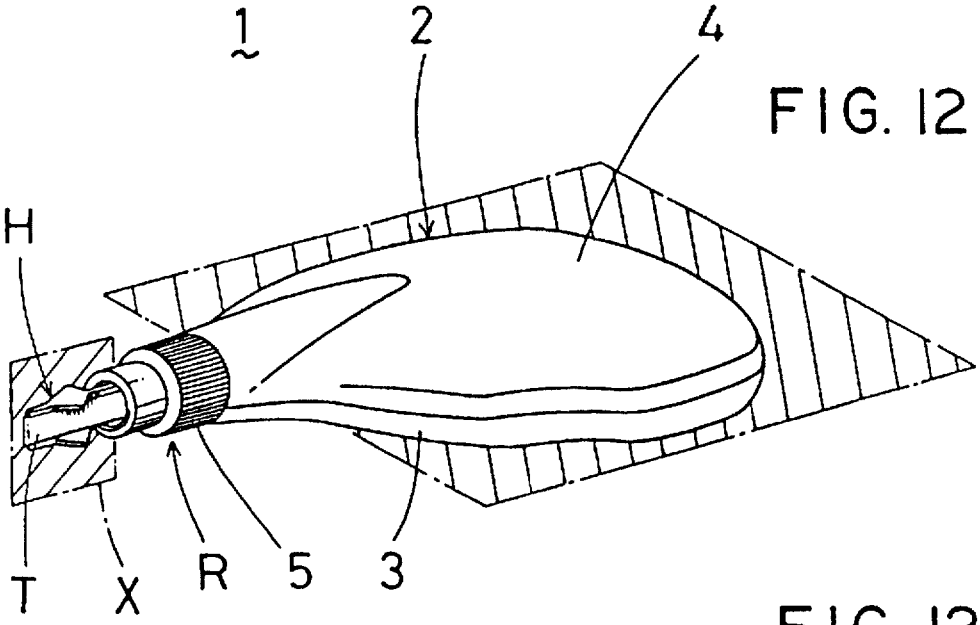
FIG. 12 is perspective views showing an appearance of the erasing tool, FIG. 12 (*a*) showing a state when the coating film transfer head is in a coating film transfer tape replacement position, and FIG. 12 (*b*) when the head is in an application position.
Figure 12:
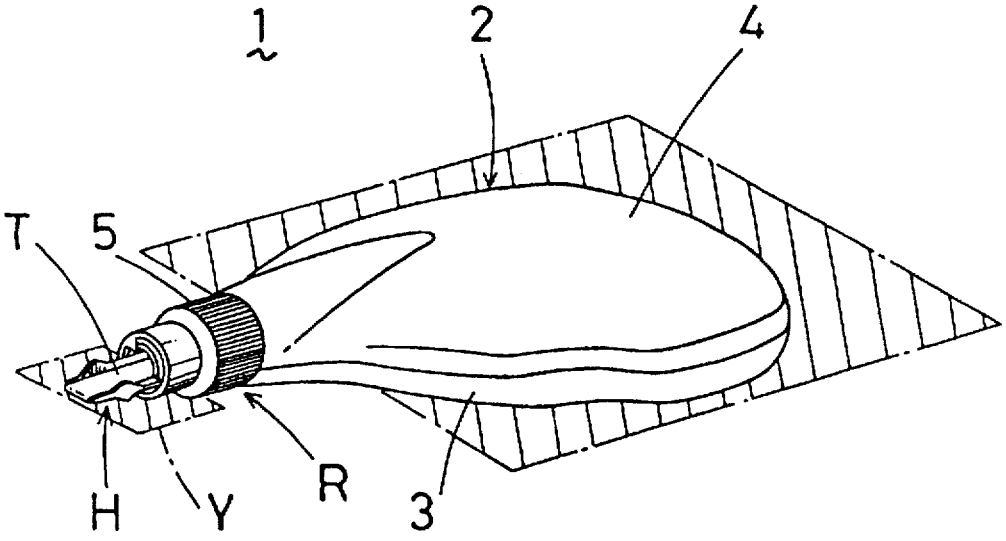

The erasing tool 1 comprises, as shown in FIG. 1, a tape cartridge C, a tape driving part D, a coating film transfer head H and a rotationally operated part R attached to a case 2 that can be hand-held for operation. In the erasing tool 1, the head H can be rotationally operated between a coating film transfer tape replacement position (and vertical pulling position) X shown in FIGS. 12 (*a*) and 13 (*a*) and an application position (lateral pulling position) as shown in FIGS. 12 (*b*) and 13 (*b*). The parts are described individually below.

I. Case 2:

The case 2 is formed in a flat box-like shape as shown, and has a front geometry and dimensions sufficient for incorporating the tape cartridge C and tape driving part D. As described later, flat front and back surfaces 2*a*, 2*b* of the case 2 provide gripping surfaces for manually holding the tool during operation.

The case 2 is a plastic molding obtained by injection or other molding method, and comprises disassemble blocks of a main case body 3 and a cap 4. For this purpose, in an opening of the main case body 3, a fitting recess 3*a* is provided around the entire circumference thereof, and a fitting rib 4*a* is formed in the cap 4 so that it can be received by the fitting recess 3*a* for engagement therewith. In a rear end of the main case body 3, an engagement part 3*b* is formed, and an engagement claw is formed in the cap 4 for engagement with the engagement part 3*b*. The main case body 3 and the cap 4 have semicylindrical halves 3*c* and 4*c* in a leading end thereof, respectively, and the semicylindrical halves 3*c*, 4*c* are connected and integrated by a cap member 5, which will be described later.

Thus, for assembling the case 2, first of all, the engagement part 3*b* is brought into engagement with the engagement claw 4*b* in the cap 4, then the semicylindrical halves 3*c*, 4*c* are assembled and integrated with each other, while the fitting rib 4*a* is fitted in the fitting recess 3*a*. Finally, by fitting the cap member 5 over the assembled part (cylindrical leading end) 6, assembly of the case 2 is completed.

In addition, the main case body 3 has an access window 7 (see FIG. 7) for adjustment of a coating film transfer tape T, when it is loose, as described below. The cap 4 has three balance confirmation windows 8*a* to 8*c* for confirming the amount of the coating film transfer tape T remaining for application.

II. Tape cartridge C:

The tape cartridge C is a component which is replaceable as a consumable item. The detailed structure of the tape cartridge C is shown in FIGS. 2 to 5. The tape cartridge C comprises a pay-out reel 11 with the coating film transfer tape T wound thereabout and a winding or winding-up reel 12 for collecting used coating film transfer tape T' which are rotatably provided on a support base 10. The tape cartridge C is detachably attached to the tape driving part D of case 3, as shown in FIG. 6.

The support base 10 comprises a thin flat plate, and is materially and dimensionally selected to be as thin and compact as possible but thick enough to provide sufficient strength for holding the reels 11, 12. In other words, the support base 10 is required to function for holding the reels 11, 12 only until they are attached to the tape driving part D, and should be as thin and compact as possible, in order that at least the minimum strength for achieving the function is assured.

Figure 3:
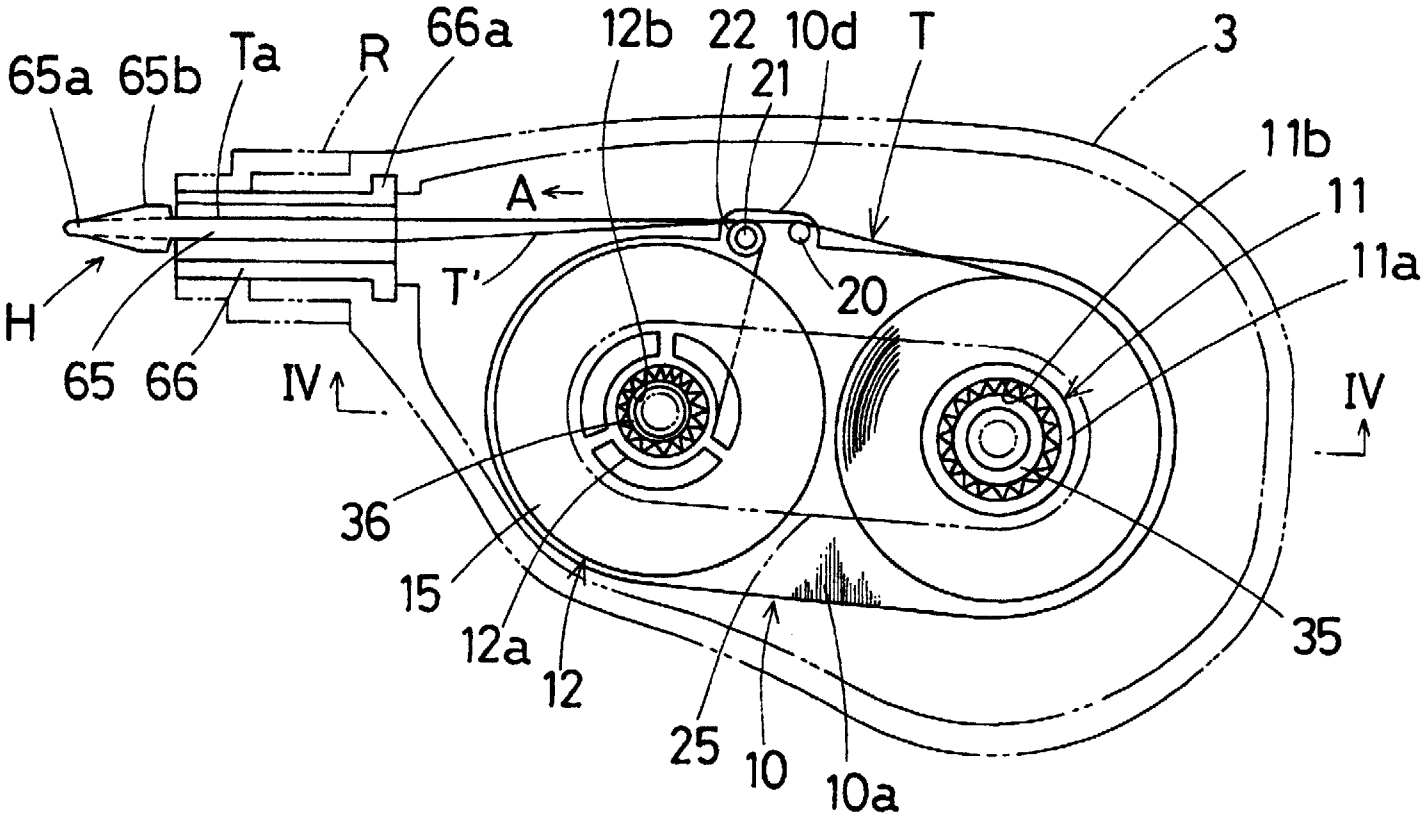
FIG. 3 is a front view of the tape cartridge.

In the embodiment shown, the support base 10 is made of As (acrylonitrile-styrene) resin or ABS (acrylonitrile-butadiene-styrene) resin, and is dimensionally set to a thickness of 1 mm or less. A front surface of the support base 10 is formed with a part extending geometrically along an outer circumference of the reels 11, 12, as shown in FIG. 3. A surface or upper surface 10*a* of the support base 10 serves as a running and guiding surface of the coating film transfer tape T.

The pay-out reel 11 and winding reel 12 are provided with hollow drum parts 11*a*, 12*a*, respectively, for winding the coating film transfer tape T thereabout. The drum parts 11*a*, 12*a* are provided with attachment holes 11*b*, 12*b* having such a tooth profile engagement part such as serrations or a spline in the center.

Figure 5:
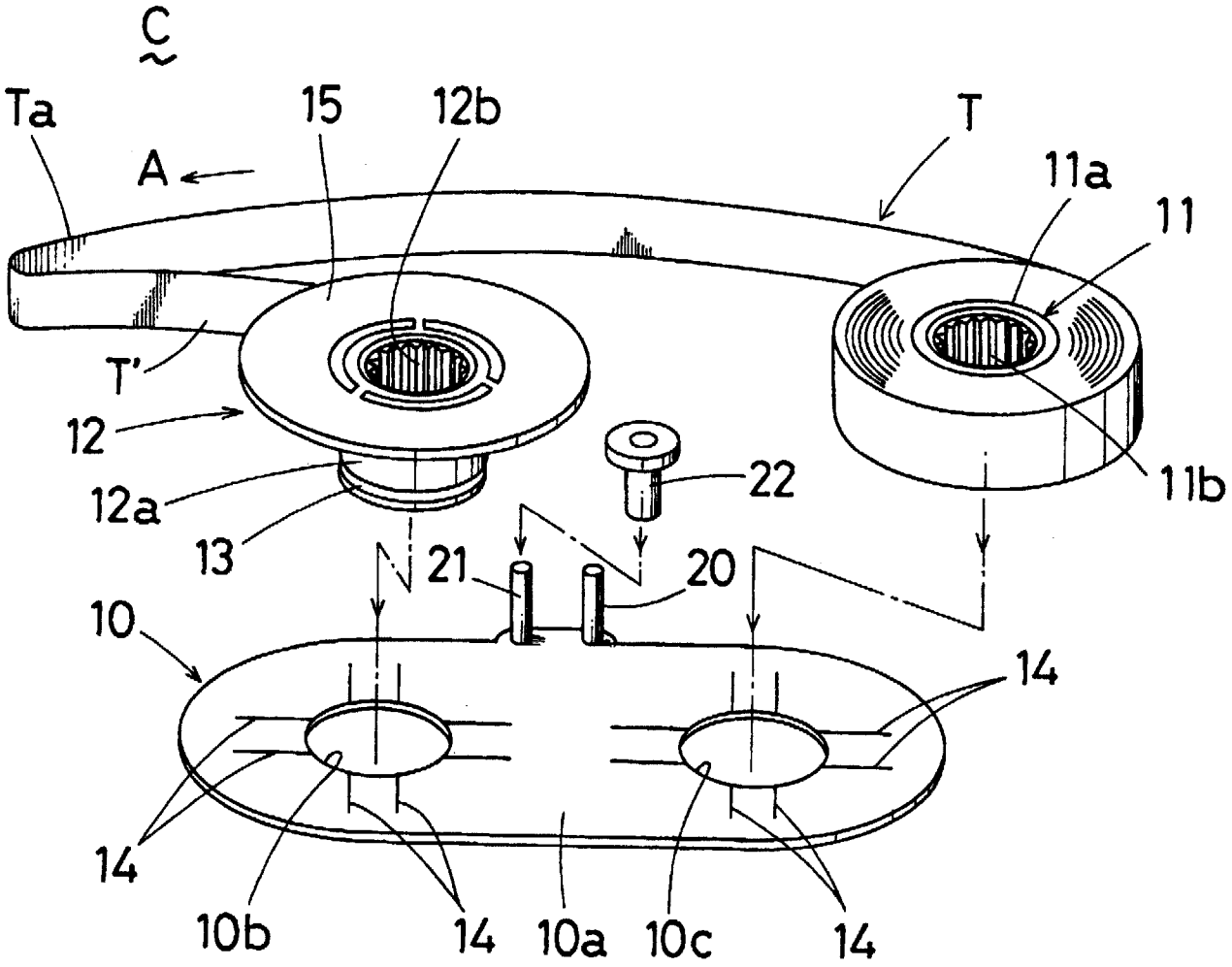
FIG. 5 is an exploded perspective view showing the tape cartridge.

The drum parts 11*a*, 12*a* of the reels 11, 12 are rotatably supported with support ends thereof in support holes 10*b*, 10*c* of the support base 10. Practically, annular fitting grooves 13,13 are formed in the support ends of the drum parts 11*a*, 12*a*, respectively, and the fitting grooves 13,13 are rotatably fitted and supported in an inner diametric edge of the support holes 10*b*, 10*c*. In this connection, in an outer circumferential part of the support holes 10*b*, 10*c*, as shown in FIG. 5, a plurality of slits 14,14 . . . are radically extended for inserting the drum parts, respectively.

The coating film transfer tape T is wound about an outer circumference of the drum part 11*a* on the pay-out reel 11, and a leading end on the pay-out side is connected to an outer circumference of the drum part 12*a* in the winding reel 12. The coating film transfer tape T structurally consists of, for example, a film base (about 25 to 38 μm thick) of a plastic material such as polyester or acetate films, or paper, a release agent layer such as vinyl chloride-vinyl acetate copolymer resin or low molecular polyethylene formed in one side of the film base, a white corrective paint layer over the release agent layer, and an adhesive (pressure sensitive adhesive) layer such as pressure sensitive polyurethane, further applied over the paint layer (detailed structure not shown). For the corrective paint layer, so-called dry type paint is employed that allows over writing on the corrected area immediately after the paint is transferred.

While a free end of the drum part 11*a* in the pay-out reel 11 is left as it is to be an open end, a free end of the drum part 12*a* in the winding reel 12 is provided with a guide flange 15 for running the tape.

Such a structure is employed because it is desired, in the side of pay-out reel 11, that the free end of drum part 11 a should have no flange in order to smoothly wind the coating film transfer tape T during the manufacturing process, while the coating film transfer tape T can be smoothly paid out even without a guide flange. On the other hand, on the side of winding reel 12, the guide flange 15 is essential for smoothly winding and collecting the coating film transfer tape T'. If the guide flange is absent, it is difficult to wind the coating film transfer tape T' in alignment about the outer circumference of drum part 12*a*, because it goes out of control, and the wound and collected coating film transfer tape T' may, in the worst case, disturb rotation of the winding reel 12, causing an inoperative condition of the erasing tool 1.

As shown in FIG. 6, the reels 11, 12 are positioned in the support base 10 such that the attachment holes 11*b*, 12*b* are coaxial, respectively, with the pay-out rotation part 30 and winding rotation part 31 in the tape driving part D.

Additionally, a mounting flange 10*d* (see FIG. 3) is formed integrally with the support base 10 in the vicinity of attachment positions of the reels 11, 12, and a pair of guide pins 20, 21 are integrally provided upright in the mounting flange for guiding the coating film transfer tape T. The guide pin 20 is for guiding the coating film transfer tape T paid out of the pay-out reel 11, and the other guide pin 21 is for guiding the coating film transfer tape T' that is wound and collected by the winding reel 12.

Further, a collared guide roller 22 is freely rotatably pivoted by the guide pin 21 in the winding side. By means of such an arrangement, guiding of the coating film transfer tape T' is enhanced for smoothly winding it in alignment, and the problem of the coating film transfer tape T' becoming wound about the guide pin 21 is avoided, even when a part of the coating film is left on the coating film transfer tape T' due to a failure in film transfer. A similar guide roller may be also attached to the guide pin 20 in the pay-out side.

A leading pay-out end portion Ta of the coating film transfer tape T comprises a film base without any coating film so that it is easily set to the case 2, and is set in such a condition that a part of its length corresponding to a distance between the pay-out reel 11 to the position of the head H is already paid out. In order to maintain the setting condition, a stopper 25 is employed, as shown by a line depicted at two short dashes and a continuous line in FIGS. 3 and 4.

The stopper 25 is made of a material similar to that of the support base 10. The stopper 25 is formed in such shape and dimensions, as shown in the figures, that it extends over the attachment holes 11*b*, 12*b* of reels 11,12, and is provided with a pair of engagement projections 25*a*, 25*b* on a lower surface thereof. Then, by removable fitting engagement between the engagement projections 25*a*, 25*b* and the attachment holes 11*b*, 12*b*, respectively, the reels 11,12 are stopped and held against rotation. The stopper 25 may be made of paper.

Thus, in the tape cartridge C constructed in such a manner, as shown in FIGS. 6(*a*) and (*b*), the support base 10 rests on the rotation parts 30, 31 of the tape driving part D with the reels 11, 12, fitted to the rotation parts 30, 31. The reels 11, 12 are thereby detachably connected to the rotation parts 30, 31, respectively for integral rotation therewith by a single operation. On the other hand, by simply lifting the support base 10, the reels 11, 12 can be easily removed from the rotation parts 30, 31 by means of a single operation.

Figure 7:
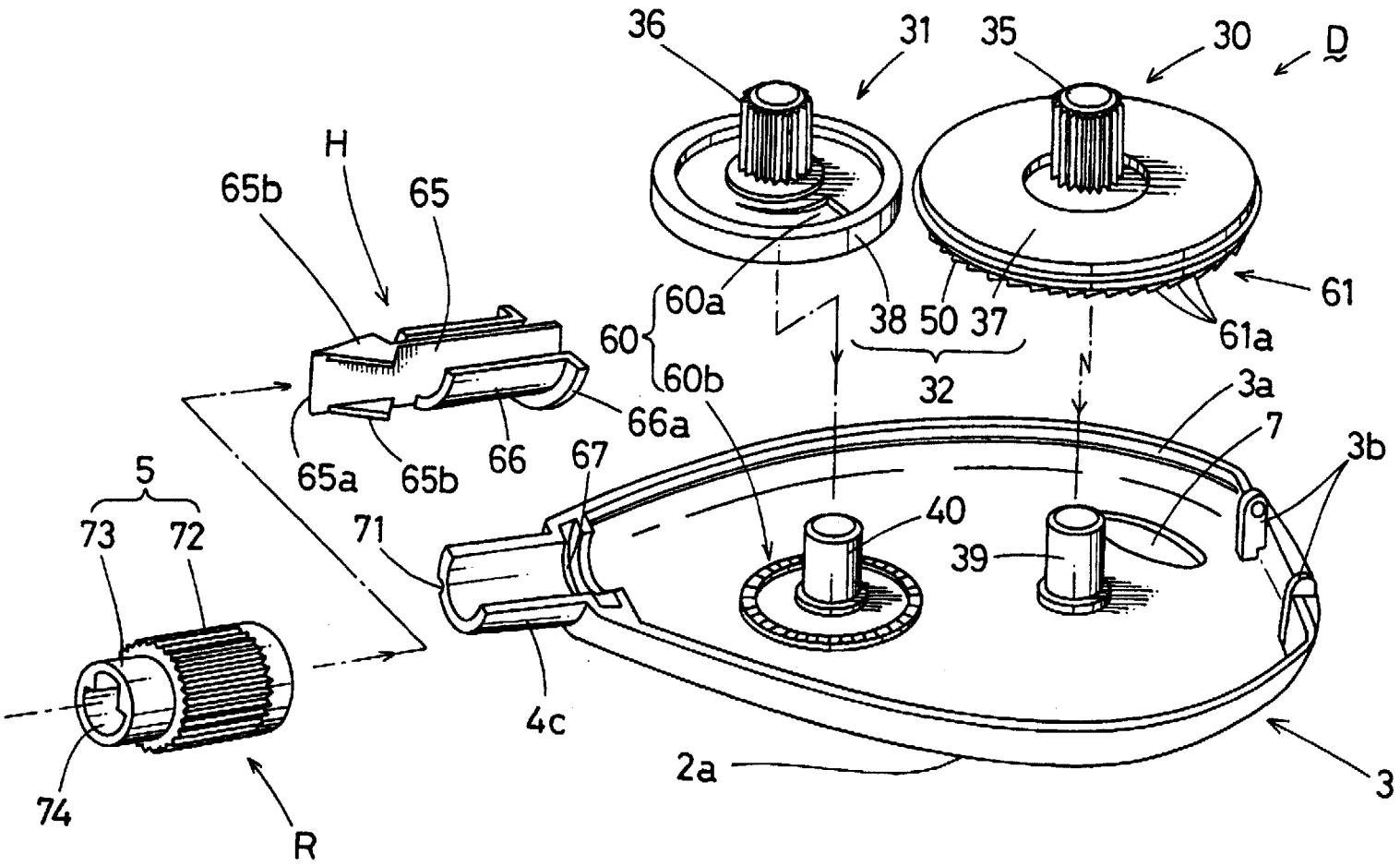
FIG. 7 is an exploded perspective view showing the internal structure of a case body of the erasing tool.

III. Tape driving part D:

A tape driving part D is provided in the main case body 3. The tape driving part D mainly comprises, as shown in FIGS. 6 and 7, the pay-out rotation part 30 for rotatably driving the pay-out reel, a winding rotation part 31 for rotatably driving the winding reel 12 and an interlocking part 32 for interlocking the rotation parts 30, 31.

The pay-out rotation part 30 and winding rotation part 31 comprise hollow rotating shafts 35, 36 formed integrally with rotating disks 37, 38, respectively. The rotating shafts 35, 36 are freely rotatably supported by hollow support shafts 39, 40 and are provided upright on an inner surface of the main case body 3.

In an outer circumference of the rotating shafts 35, 36, a toothed engagement part, such as serration and spline, is formed, respectively, in correspondence with the toothed engagement part of the attachment holes 11*b*, 12*b* in the pay-out reel 11 and winding reel 12, as shown in the figures. Then, the pay-out reel 11 and winding reel 12 are attached to the rotating shafts 35, 36 for integral rotation therewith, as described above, as the attachment holes 11*b*, 12*b* are disengageably fitted with and supported by the engagement parts.

The interlocking part 32 is for interlocking the winding rotation part 31 and pay-out rotation part 30, and comprises the rotating disks 37, 38 and slide means 50.

The slide means 50 serves for transferring rotational movement between the rotation parts 30, 31 and functioning additionally as slide means to synchronize pay-out and winding speeds of the coating film transfer tap T in the pay-out and winding reels 11, 12, and practically comprise a frictional member, for example, an O ring of silicone rubber and the like. The frictional member 50 is attached to an outer circumference of the rotating disk 37 in the driving side, and frictionally engages an outer circumference of the other rotating disk 38 on the driven side.

For reducing the cost associated with the frictional member 50, the frictional member 50 may be attached, in a not shown manner, to an outer circumferential part of the rotating disk 38 on the driven side, which has an outer diameter less than that of the rotating disk 37. In such a case, the frictional member 50 frictionally engages with the outer circumference of the rotating disk 37.

The ratio of rotation, or the ratio of the outer diameter, between the rotating disks 37, 38 in the driving and driven sides is appropriately determined, considering the winding diameter of the coating film transfer tape T and T' in the reels 11, 12, so that the coating film transfer tape T can be smoothly paid out, and wound.

Accordingly, by pressing action of the head H, as will be described later, when a tensile force (in the direction of arrow A) applied to the coating film transfer tape T acts as a rotational torque to pay-out reel 11, the pay-out reel 11 and thereby the rotating disk 37 in the pay-out rotation part 30 are rotated. The rotatable torque effects rotation of the rotating disk 38 of the winding rotation part 31 that is on the driven side and further interlockingly the winding reel 12 by means of the frictional force of the frictional member 50, and the used coating film transfer tape T' is, therefore, automatically wound.

In this case, the ratio of rotation (corresponding to the ratio of outer diameters) between the rotating disks 37 and 38 in the driving and driven sides is unchanged at any time, while the ratio of outer diameter between the coating film transfer tape T about the pay-out reel 11 and the coating film transfer tape T' about the winding reel 12 shows a time-course change, and is inconstant. It means that the outer diameter of the coating film transfer tape T about the pay-out reel 11 is gradually reduced as the tape is used, while the outer diameter of the coating film transfer tape T' about the winding reel 12 is increased as it is wound up.

Therefore, the winding speed of the winding reel 12 is increased in comparison with the pay-out speed of pay-out reel 11 as time elapses, and the rotational torque acting to the pay-out reel 11 is also gradually increased, because the speeds are asynchronous with each other. Then, as the rotational torque overcomes the frictional force of the frictional member 50, and the rotating disk 37 in the driving side rotatively slips in relation to the rotating disk 38 in the driven side, the pay-out speed and winding speed are synchronized with each other, and a smooth driving of the coating film transfer tape T is assured.

Figure 8:
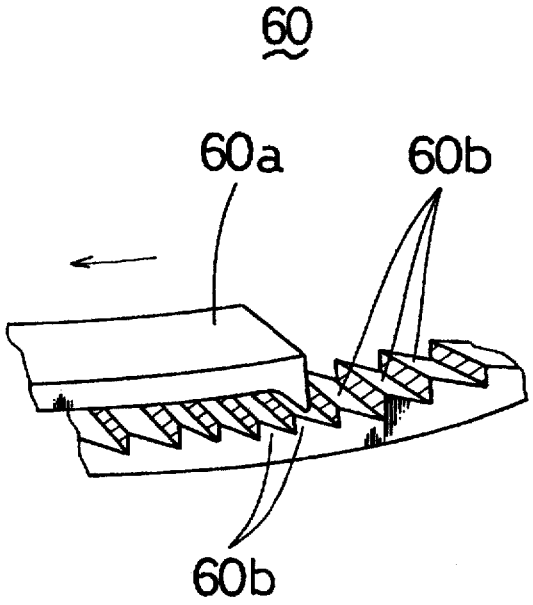
FIG. 8 is a magnified perspective view for explaining operation of a backstop arrangement in the erasing tool.

As shown in FIGS. 7 and 8, the winding rotation part 31 is provided with a backstop mechanism 60 for preventing reverse rotation of the reels 11, 12. The backstop mechanism 60 comprises an engagement claw 60*a* provided in the rotating disk 38 and multiple backstop claws 60*b*, 60*b*. . . arranged in the form of a ring concentric with hollow supporting shaft 40 on an inner surface of the main case body 3. Thus, when the reels 11, 12 are turned in the direction of the arrow in FIG. 8, the engagement claw 60*a* is elastically changed in shape, and gets over the backstop claws 60*b*, 60*b* . . . to allow normal rotation. On the contrary, when the reels 11, 12 are turned in the direction opposite to that of the arrow, the engagement claw 60*a* is engaged with one of the backstop claws 60*b*, 60*b* . . . . and prevents the reverse rotation. The backstop mechanism may be employed in the payout rotation part 30.

In association with the backstop mechanism 60, a tension correcting dial 61 is provided in the pay-out rotation part 30 for maintaining the coating film transfer tape T under proper tension, as shown in FIG. 7. The tension correcting dial 61 comprises multiple notches 61*a*, 61*a* . . . formed in a lower part of the rotating disk 37 over the entire length of the outer circumference thereof. In correspondence with the tension correcting dial 61, an access window 7 is provided in the main case body 3, and the tension of the coating film transfer tape T is appropriately corrected by manually rotating the tension correcting dial through the access window 7.

IV. Coating film transfer head H:

The coating film transfer head H is for pressing the coating film transfer tape T against such correction area (transfer area) as an error on a sheet surface, and is attached to an inner circumference of the cylindrical leading end 6 of the case 2 and is rotatable about an axis.

The head H is made of a plastic material having some degree of elasticity, and comprises a head body 65 for guiding and pressing the coating film transfer tape T and a bearing part 66 held in the cylindrical leading end 6.

The head body 65 is a thin plate slightly wider than the coating film transfer tape T, and is tapered in section such that is gradually reduced in thickness toward a leading end thereof. A leading end 65*a* of the head body provides a pressing part for pressing the coating film transfer tape T against the substrate in need of correction. In addition, the head body 65 is formed with guide flanges 65*b*, 65*b* on either edge thereof for guiding the coating film transfer tape T.

Figure 9A:
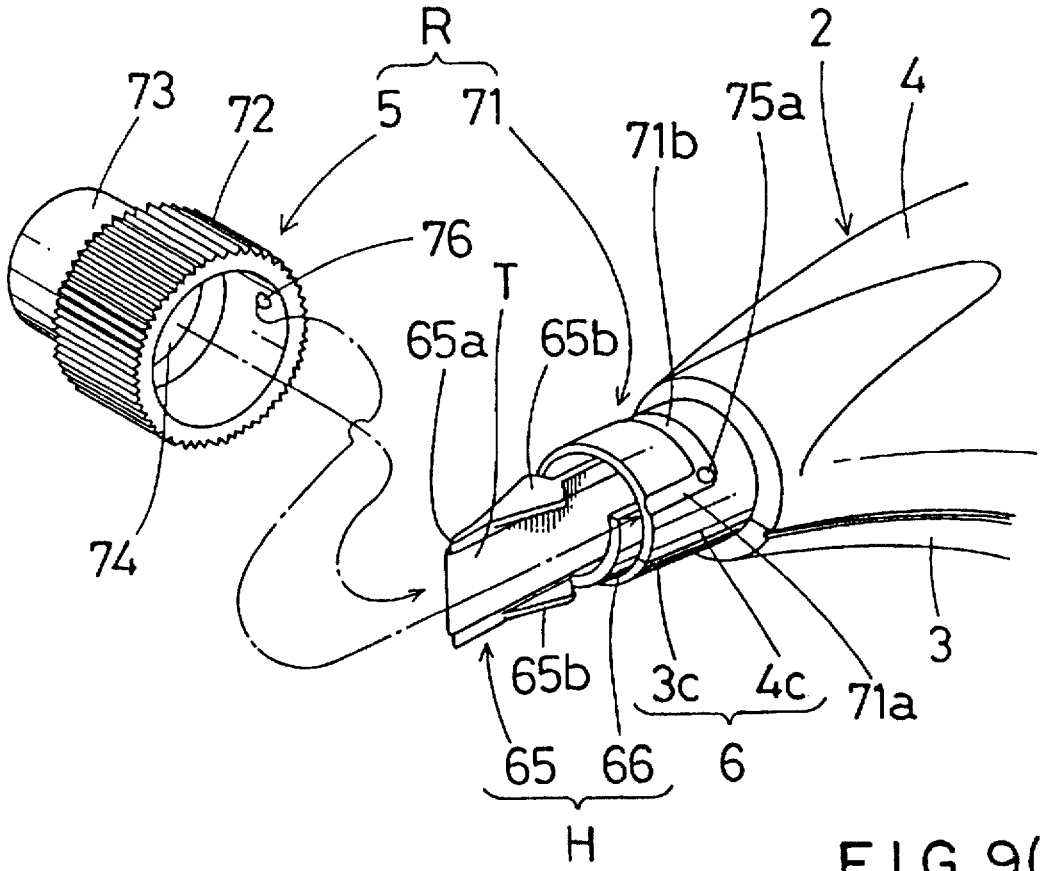
FIG. 9 is perspective views showing the structure of a rotationally operated part in the erasing tool, FIG. 9 (*a*) showing a relation between a coating film transfer head and the rotationally operated part, and FIG. 9 (*b*) a positioning element in the rotation part.
Figure 9B:
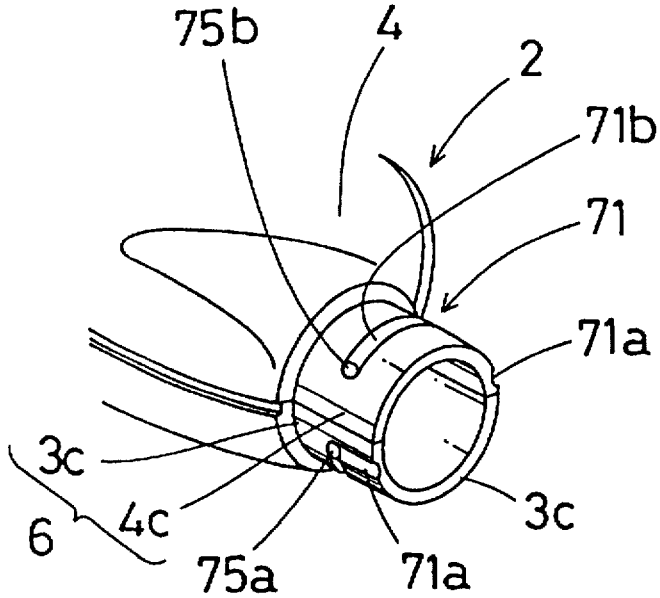

The bearing part 66 has an accurate section open in an upper part thereof to form a semicylindrical shape, as show in FIGS. 7, 9 (*a*) and 10, and is rotatably supported in the semicylindrical halves 3*c*, 4*c* of the case 2. Further, an arcuate flange 66*a* is formed in a base end of the bearing part 66 for axial positioning, and is rotatably fitted to a cylindrical engagement groove 67 in the semicylindrical halves 3*c*, 4*c*. By means of such arrangement, the head H is axially positioned in the cylindrical leading end 6 of case 2, and is rotatably attached about the axis.

V. Rotationally operated part R:

The rotationally operated part R is for rotationally operating the head H, and comprises a cap member 5 detachably attached to the cylindrical leading end 6 and a positioning part 71 provided on an outer circumference of the cylindrical leading end 6.

The cap member 5 is an integral molding of plastic material, and comprises a base part 72 fitted over the cylindrical leading end 6 and an engagement part 73 integrally engaged with the head H in the rotating direction.

The base part 72 serves as an assembly fixing member for the case 2 and a rotationally operated part. A cylindrical bore in the base part 72 is set such that the base part can be rotatably fitted over the outer circumference of cylindrical leading end 6, and multiple toothed anti-slip ribs are formed in an outer circumference thereof. The engagement part 73 is provided with a through hole 74 for receiving the head H. The through hole 74 is dimensionally configured such that the cap member 5 and the head H are integrally engaged with each other in the rotating direction, when the head H is received through the hole, as shown in FIG. 10.

The positioning part 71 is for resiliently positioning and fixing the cap member 5 in position in the direction of rotation, and is provided as a pair opposing to each other on an outer circumference of the cylindrical leading end 6. The pair of positioning parts 71, 71 has identical structure, and the positioning part 71 in the side of cylindrical half 4*c* in the cap 4 is described below.

Figure 10:
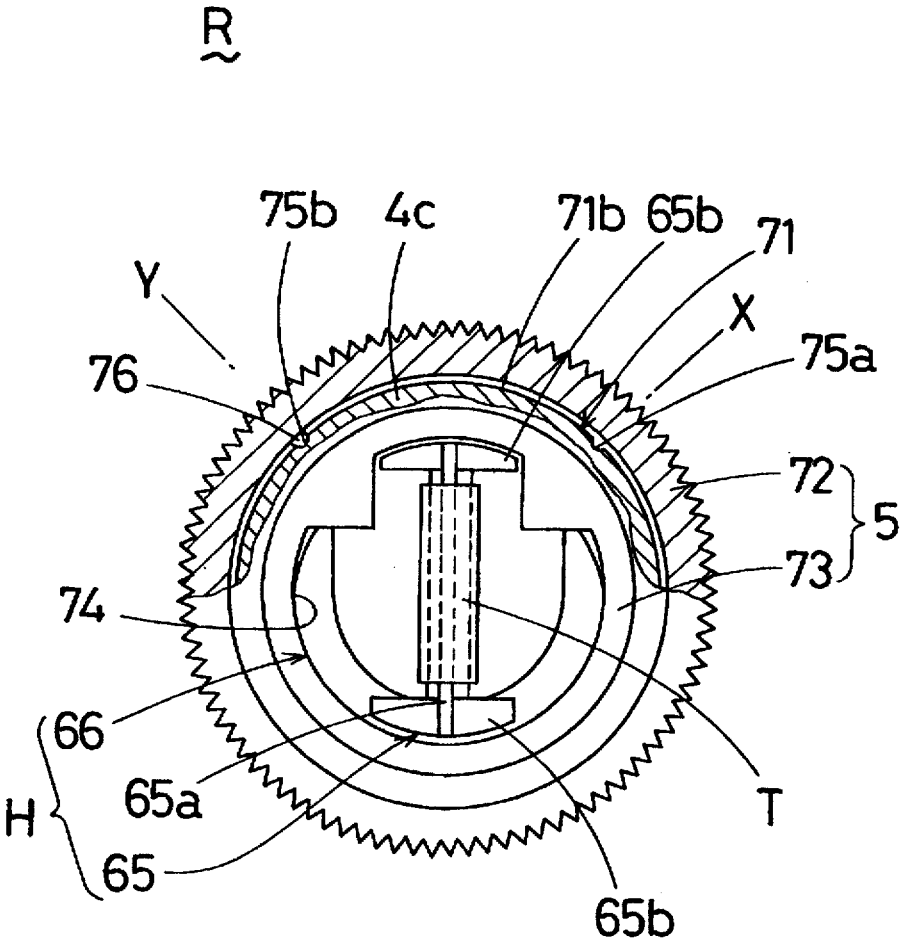
FIG. 10 is a partly cut-open front view showing the coating film transfer head and rotationally operated part in the erasing tool, when the coating film transfer head is in an application position.

The positioning part 71 comprises, as shown in FIGS. 9 and 10, a fit-in guide groove 71*a* extending linearly in the axial direction of the cylindrical leading end 6, and an anchor guide groove 71*b* extending from an end of the fit-in guide groove 71*a* in the circumferential direction of the cylindrical leading end 6. In the embodiment shown, the anchor guide groove 71*b* is formed with a range of central angle of 90° of the cylindrical leading end 6, as shown in FIG. 10, and is provided with first and second engagement parts 75*a* and 75*b* in each end, respectively, thereof.

The first and second engagement parts 75*a* and 75*b* are formed as recesses which are deeper than the guide grooves 71*a*, 71*b*. The engagement recesses 75*a*, 75*b* are disengageably engaged with an engagement projection (engagement part) 76 that is provided on an inner circumference of the cap member 5. In other words, the engagement projection 76 is geometrically and dimensionally set such that it is guided along the guide grooves 71*a*, 71*b*, while it is elastically changed in shape to some relative extent, and fitted in the engagement recesses 75*a*, 75*b* through elastic restoration.

The engagement projection 76 and engagement recesses 75*a*, 75*b* are positionally set for engagement with each other in such relation as described below.

Thus, when the engagement projection 76 of the cap member 5 is in engagement with the first engagement recess 75*a*, the head H is in a coating film transfer tape replacement position (vertical pulling position) X, as shown in FIGS. 12 (*a*) and 13 (*a*). In such a state, the pressing part 65*a* of the head H guides the coating film transfer tape T in the same attitude as it is wound about the pay-out and winding reels 11 and 12, that is, with front and back surfaces of the coating film transfer tape T oriented generally perpendicularly (transversely) to the gripping surfaces 2*a*, 2*b*.

On the other hand, when the engagement projection 76 is in engagement with the second engagement recess 75b (see FIG. 10), the head H is, as shown in FIGS. 12 (*b*) and 13 (*b*), in an application position (lateral pulling position) Y. In such a state, the pressing part 65a of the head H guides the coating film transfer tape T in such an attitude that it is generally faced against the gripping surfaces 2a, 2b of case 2, that is, with the front and back surfaces of coating film transfer tape T facing in a direction approximately the same as that of (in parallel with) the gripping surfaces 2a, 2b.

Now, operation of the erasing tool 1 constructed in such manner is now described below.

Figure 11A:
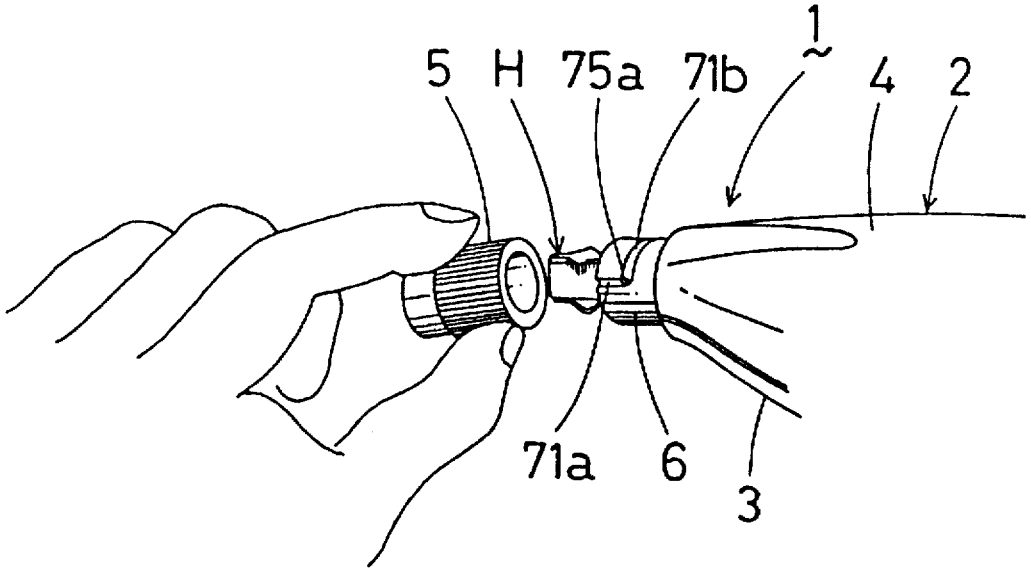
FIG. 11 is perspective views for explaining operation of the rotationally operated part, FIG. 11 (*a*) showing a cap member attached to a cylindrical leading end of a case, and FIG. 11 (*b*) rotating operation of the cap member.
Figure 11B:
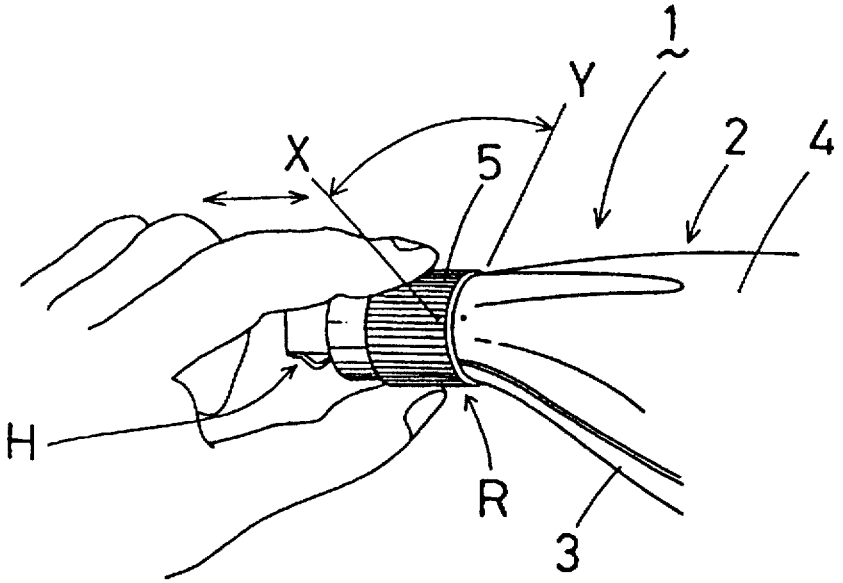

A. Operation:

As shown in FIG. 11(*b*), the tool can be used in two different ways by rotating the cap member 5, and selectively positioning the head H in one of two positions, the vertical pulling position X (see FIGS. 12(*a*) and 13(*a*)) and lateral pulling position Y (See FIGS. 12(*b*) and 13(*b*)).

1. Vertical pulling use: (See FIG. 14(*a*))

This is suitable for partially correcting a sentence which is vertically written, for example, in Japanese. For such an operation, as shown in the figure, the gripping surfaces 2a, 2b of the case 2 are held by fingers like a writing tool. Then, with the tool held in such an attitude, the pressing part 65a of head H is brought into contact with the starting end (upper end) of a correction area (transfer area) 80 containing an error or the like to be corrected in a sheet surface, then the case 2 is moved vertically or downward in relation to the sheet surface, and stopped at the terminal end (lower end) of the correction area 80.

In such an operation, the corrective paint layer (white) of the coating film transfer tape T in the pressing part 65a of the head H is separated from the film base, and transferred to cover the correction area 80. The error or the like is thereby erased, and a correct letter can be readily written on the white corrective paint layer.

2. Lateral pulling use: (See FIG. 14(*b*))

This is suitable for partially correcting a sentence which is laterally written, for example, in English. For such an operation, as shown in the figure, the gripping surfaces 2a, 2b of the case 2 are held by fingers like a writing tool, and the pressing part 35a of the head H is brought into contact with the starting end (left end) of a correction area 80 with the tool held, as described above. Then, by moving the case 2 laterally or rightward in relation to the sheet surface, and stopping it at the terminal end (right end) of the correction area, an error or the like is erased, and a correct letter can be readily written in that area.

B. Replacement of tape cartridge C:

When the coating film transfer tape T is completely used, and is recovered by being wound by the winding reel 12 and thereby collected from the pay-out reel 11, the tape cartridge C should be replaced with a new one according to the following steps.

i) The head H is put into the coating film transfer tape replacement position X. That is, although no operation is required when the head H is in the vertical pulling position X, if it is in the lateral pulling position Y, the cap member 5 should be rotated, and the head H is rotationally moved from the lateral pulling position Y to the coating film transfer tape replacement position X.

Figure 13A:
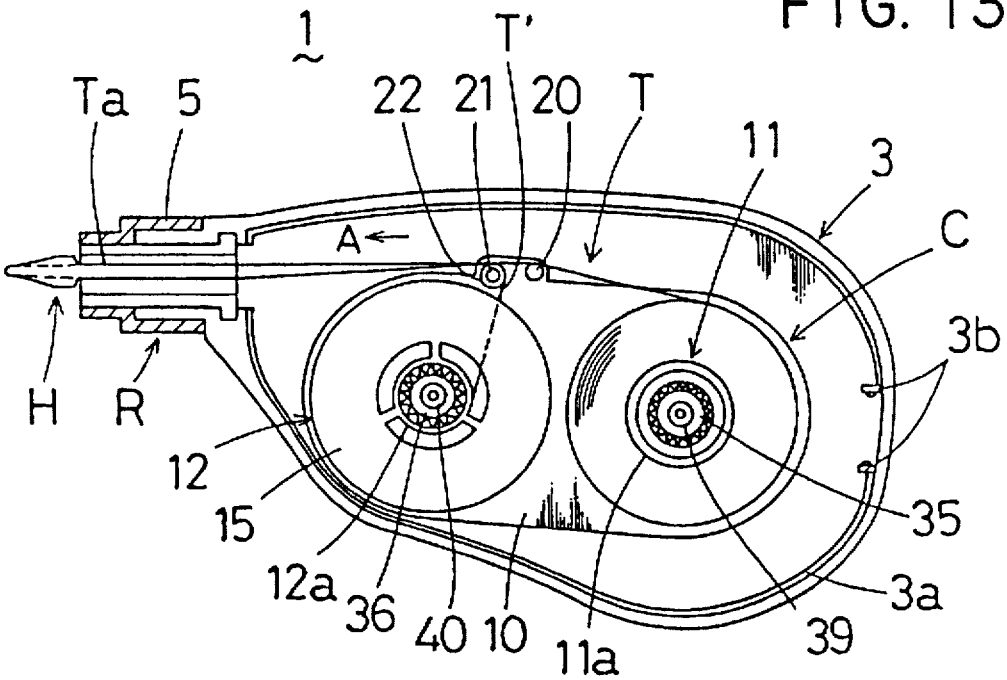
FIG. 13 is front views showing an inside of the erasing tool, FIG. 13 (*a*) showing a state when a coating film transfer head is in a coating film transfer tape replacement position, and FIG. 13 (*b*) when the head is in an application position.
Figure 13B:
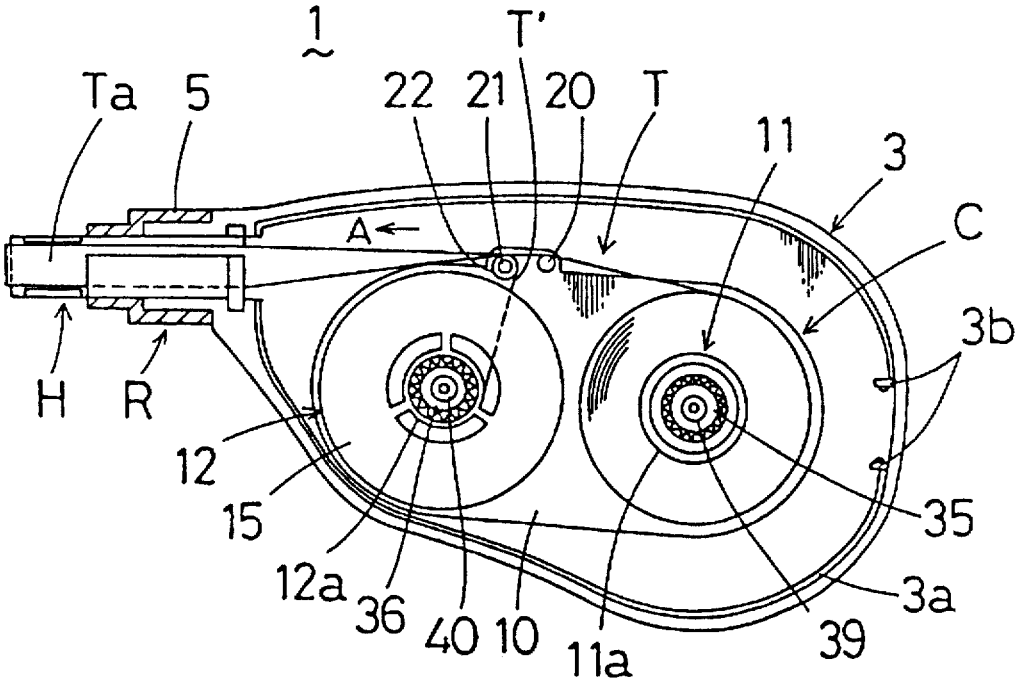
Figure 14A:
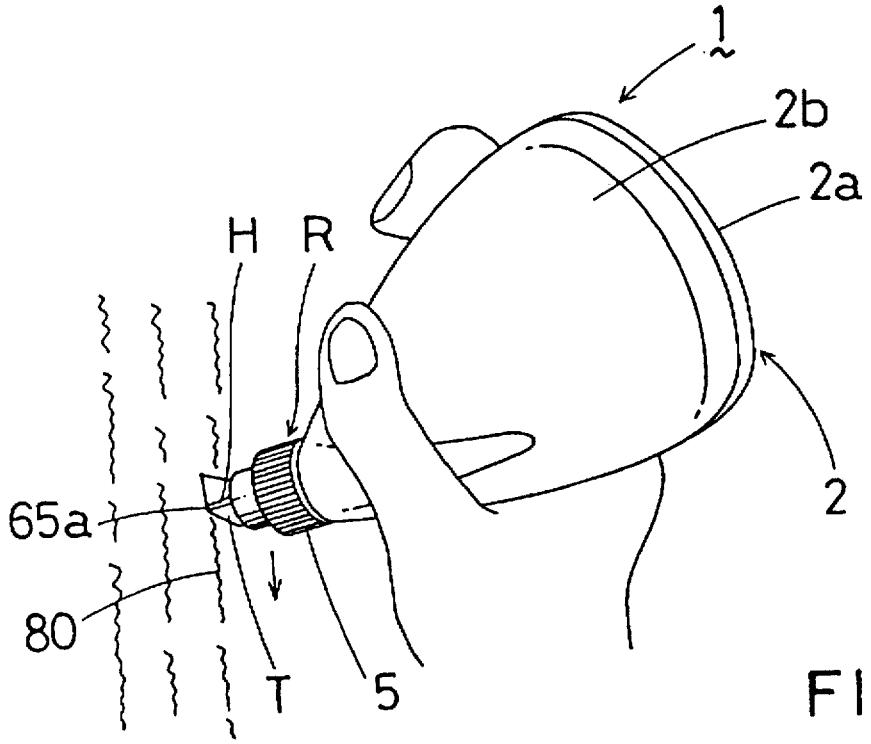
FIG. 14 is perspective views for explaining how to use the erasing tool, FIG. 14 (*a*) showing vertical pulling use, and FIG. 14 (*b*) lateral pulling use.
Figure 14B:
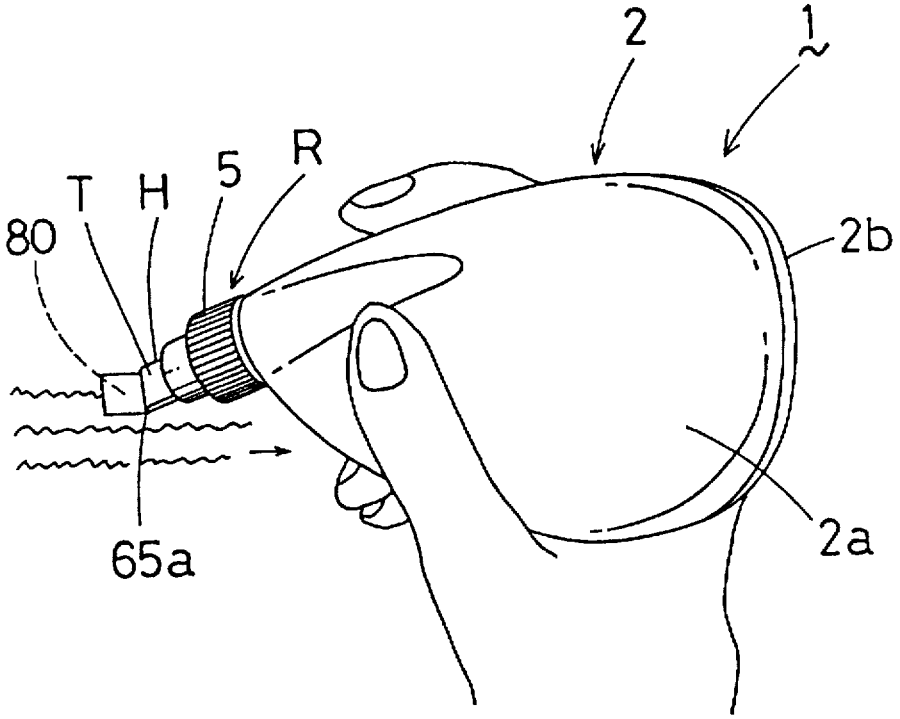

By such an operation, the coating film transfer tape T in the head H is made parallel to the winding attitude of the pay-out and winding reels 11 and 12, as shown in FIG. 13(*a*), and the coating film transfer tape T can be easily detached with respect to the head H.

ii) The case 2 is disassembled, and opened. In this operation, first the cap member 5 is pulled off the cylindrical leading end 6 of case 2, as shown in FIG. 11(*a*), then the semicylindrical half 4c is lifted with the cap 4 positioned in the upper side, and the cap 4 is removed from the main case body 3.

iii) The used tape cartridge C (empty pay-out reel 11 and winding reel 7 with the used coating film transfer tape T' collected thereabout) is detached, removing the coating film transfer tape T from a setting position of the head H.

In this operation, by simply lifting the support base 10, the pay-out reel 11 and winding reel 12 are simultaneously removed from the pay-out rotation part 30 and winding rotation part 31 of the tape driving part D.

iv) An unused new tape cartridge C (pay-out reel 11 with an unused coating film transfer tape T wound thereabout and winding reel 12) is placed as described above, then the coating film transfer tape T is set to a specified position.

In this operation, because the guide pins 20, 21 are provided on the support base 10, and setting of the coating film transfer tape T to the guide pins 20, 21 is already completed during the process of manufacturing the tape cartridge C, it is only required to set the coating film transfer tape T such that it passes through the pressing part 65a of the head H.

Besides, as the coating film transfer tape T is set with the paid-out leading end Ta paid out beforehand to a length corresponding to a distance from the pay-out reel 11 to the head H, the setting operation is easily and surely completed by merely paying-out the leading end Ta from an upper side of the head body 65 of the head H, and positioning it in both sides of the head body, as shown in FIG. 1. After the setting operation is completed, the stopper 25 is removed from the tape cartridge C.

By the setting operation, the coating film transfer tape T is set in such a manner that it is paid out of the pay-out reel 11, inverted through the pressing part 65a of the head H via the guide pin 20, and wound about the winding reel 12 via the guide pin 21, as shown in FIG. 3.

The head H may be removed, and then reattached after the sequential steps for setting the tape have been performed.

v) Then, by closing and assembling the case 2 again according to above steps in reverse order, replacement of the used tape cartridge with a new one is completed.

The embodiment described above is only a preferred mode of carrying out the invention, and it is appreciated that the invention is not limited thereto, and various design modifications may be made in the invention without departing from the spirit and scope thereof. For example, modifications described below are possible .

Concerning the tape cartridge C:

(1) By employing a film base having on one side thereof an adhesive layer over a release agent layer as the coating film transfer tape T, the tool can be used as an adhesive applicator for transferring only an adhesive layer to the sheet surface and the like.

(2) The detailed structure of the support base 10 is not limited to that of the embodiment shown, as far as it comprises a thin plate having strength at least sufficient for holding the reels 11, 12 at a spacing corresponding to that of the rotation parts 30, 31 in the tape driving part D. For example, the support base 10 can be made of a paper plate, in such a case, the guide pins 20, 21 are preferably provided in the side of the main body 3 for maintaining the strength. Correspondingly, the support base 10 is provided with a notch or through hole (not shown) as a receiving part for inserting the guide pins 20, 21.

Figure 4:
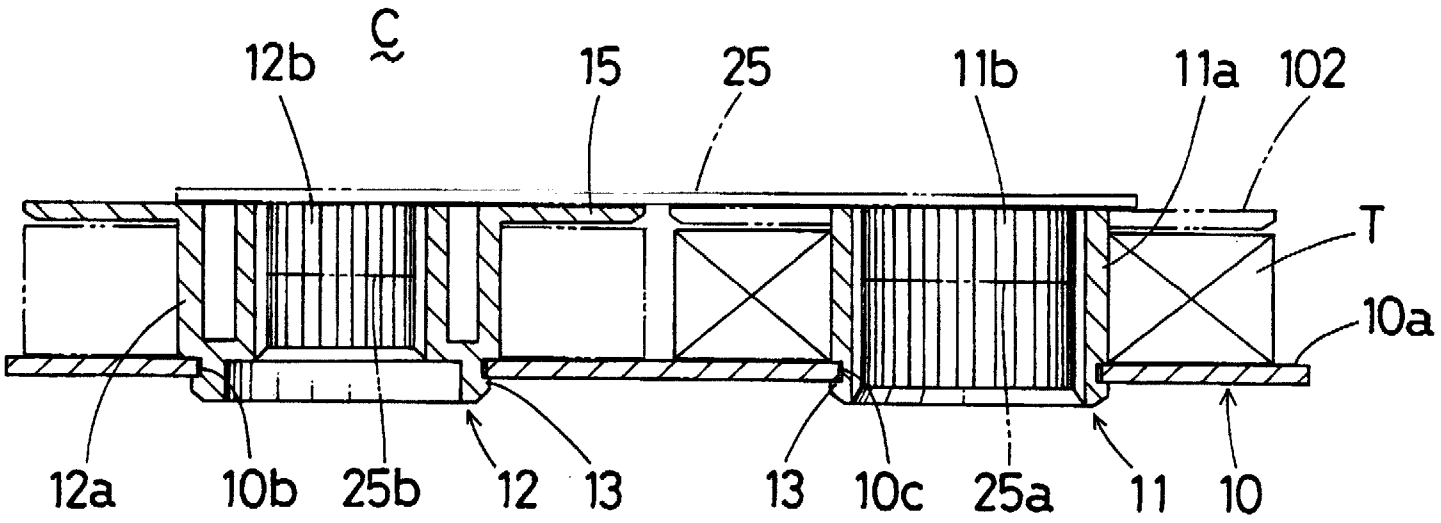
FIG. 4 is a sectional view of a tape cartridge taken along a line IV—IV of FIG. 3.

(3) Although the free end of the drum part 11a in the pay-out reel 11 is an open end in the embodiment shown, considering the manufacturing process and cost of the tape cartridge C, it may be arranged such that a guide flange 102 similar to that of the winding reel 12 may be removably attached to the free end of drum part 11*a* for guiding the tape, as shown by a two-dot long and two short dashes line in FIG. 4.

With such an arrangement, the guide flange 102 can be removed when the coating film transfer tape T is wound thereabout. Then, by attaching the guide flange 102 after winding of the tape is completed, the coating film transfer tape can be more smoothly paid out, and such convenience is surely avoided as well that the coating film transfer tape T is loosened, and detached from the drum part 11*a*.

Figure 15A:
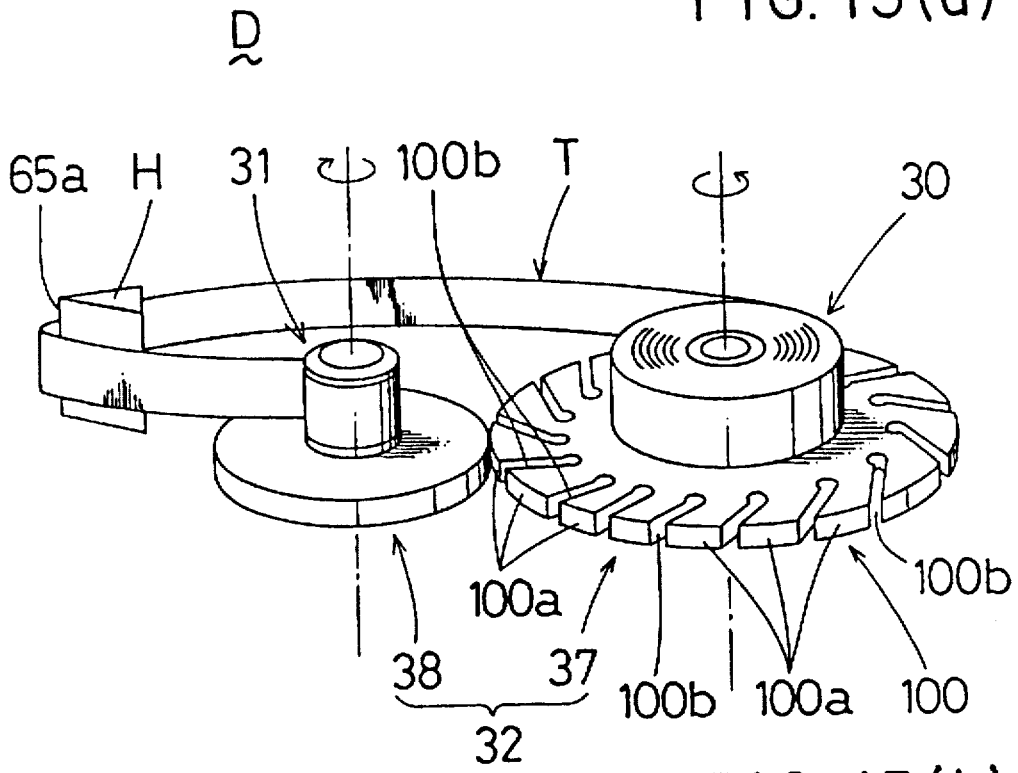
FIG. 15 (*a*) and 15 (*b*) are perspective views showing a modification example of an interlocking part of a tape driving part in the erasing tool.
Figure 15B:
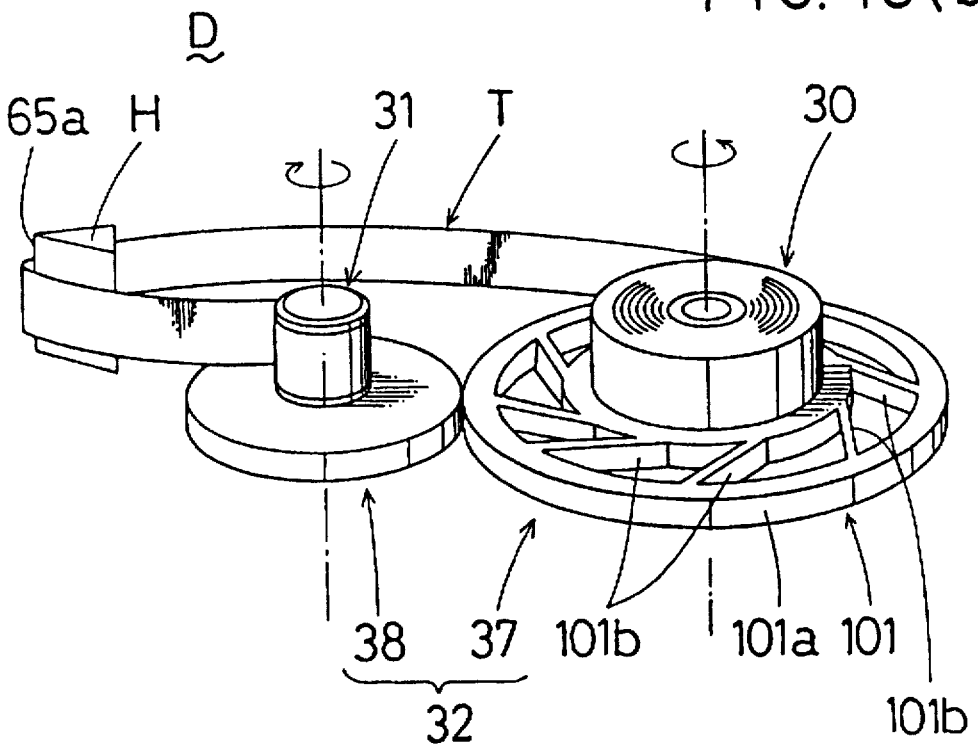
Figure 16A:
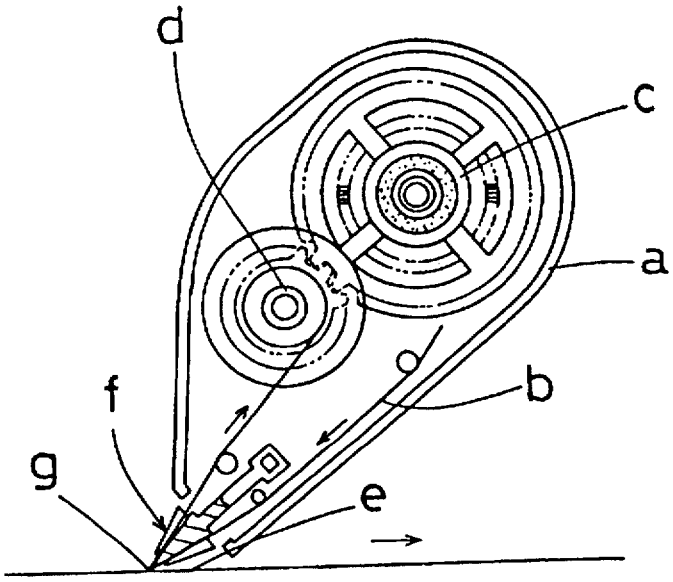
FIG. 16(a) PRIOR ART
FIG. 16 (*a*) and 16 (*b*) are partly cut-open front views showing an internal structure of a conventional erasing tool.
Figure 16B:
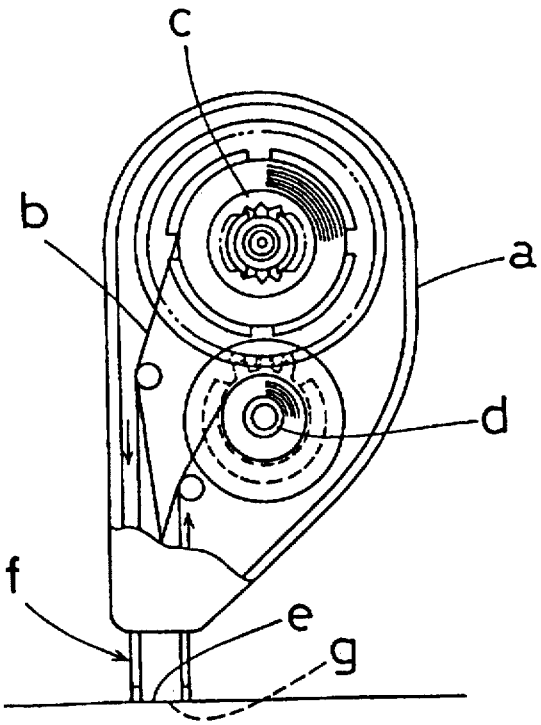
FIG. 16(b) PRIOR ART

Concerning a basic structure of the coating film transfer tool 1:

(4) A detailed structure of the interlocking part 32 is not limited to that of the embodiment described above, and may be formed, for example, without the frictional member 50 comprising an O ring for cost reduction, as shown in FIG. 15.

That is, both interlocking parts 32 shown in FIGS. 15(*a*) and (*b*), respectively, are provided with anti-slip portions 100, 101 on an outer circumference of the rotating disk 37 in the driving side, and constructed such that the anti-slip portions 100, 101 are resiliently engaged by friction with an outer circumference of the rotating disk 38 in the driven side. Both anti-slip portions 100, 101 are arranged to have some elasticity in the radial direction of the rotating disk 37.

The anti-slip portion 100 shown in FIG. 15(*a*) comprises plural elastic friction parts 100*a*, 100*a* . . . evenly spaced from each other over the entire circumference of rotating disk 37. A notch 100*b* between the elastic friction parts 100*a*, 100*a* is formed at a slight angle with respect to the radial direction of the rotating disk 37. Thus, the elastic friction part 100*a* can be elastically changed in shape to some extent in the radial direction of rotating disk 37, and its outer circumferential surface is resiliently engaged by friction with the outer circumferential surface of the rotating disk 38.

On the other hand, the anti-slip portion 101 shown in FIG. 15(*b*) comprises an outer circumferential part of the rotating disk 37 formed as an elastic friction part 101*a* of annular shape, which is supported by plural support ribs 101*b*, 101*b* . . . . The support ribs 101*b*, 101*b* . . . are extended at a slight angle with respect to the radial direction of the rotating disk 37. Thus, the elastic friction part 101*a* can be elastically changed in shape to some extent in the radial direction of the rotating disk 37, and its outer circumferential surface is resiliently engaged by friction with the outer circumferential surface of the rotating disk 38.

(5) In addition, although the interlocking part 32 of the embodiment shown is arranged to provide rotation transferring and slipping functions at a same time, as disclosed in Japanese Laid-open Utility Model No. 5-13800 and Japanese Laid-open Patent No. 5-58097, the functions may be separately and independently provided.

(6) Although the vertical pulling use and lateral pulling use can be selected as desired in the embodiment shown, by rotating the head H to two different positions, the vertical pulling position X and lateral pulling position Y, the invention is also applicable to a coating film transfer tool fixedly limited to either one of the uses. In such a case, if the tool is exclusively for lateral pulling use, the vertical pulling position X may be eliminated in the embodiment shown.

As described in detail above, because a tape cartridge according to the invention comprises a pay-out reel with a coating film transfer tape wound thereabout and a winding reel for collecting the coating film transfer tape after use, provided rotatably in a support base in a form of a flat plate, and both the reels are removably and integrally rotatably engaged, respectively, in a pay-out rotation part and winding rotation part that is provided rotatably in the case, a used cartridge together with the support base can be simply, easily, rapidly and properly replaced with a new one.

In other word, the replacement is completed only by placing the support base on the rotation parts, while the reels are in engagement with the pay-out rotation parts and winding rotation parts of the main case body, and setting the coating film transfer tape to the coating film transfer head in the main case body. Therefore, the replacement of a new cartridge for a used one can be easily and properly conducted by a general user without skill.

In addition, since the support base is in the form of a flat plate, and the reels are held only by the support base, the number of components is reduced, structure is smaller and simplified, and the cost is reduced as well. Accordingly, the coating film transfer tool itself can be reduced in size, and portability and ease of manual operation is assured, while the advantages of a refillable tool, such as saving of resources and reduction of operating cost is sufficiently provided.

A coating film transfer tool according to the invention achieves a structure capable of simultaneously satisfying two requirements that have never been met conventionally, that is, the ability to be used in a lateral pulling mode and replacement of the coating film transfer tapes by such an arrangement that the head is rotatable between a coating film transfer tape replacement position and an application position, wherein the pressing part of the head guides the coating film transfer tape as it is wound about the pay-out and winding reels in the coating film transfer tape replacement position, and also guides it, in the application position, as it generally faces against the gripping surfaces of the case.

The practical embodiment shown in the detailed description of the invention should be taken for clarifying technical details of the invention only, and the invention, therefore, is not limited to the embodiment described above, and should not be understood in a narrow sense, but should be understood in a broad sense that various modifications may be made in the invention within the spirit thereof and the scope defined by the claims.

What is claimed is:

1. A tape cartridge for use in a coating film transfer tool, the coating film transfer tool is for transferring a coating film disposed on a coating film transfer tape to a sheet surface and the like, the coating film transfer tool including a case, said tape cartridge, a coating film transfer head attached to said case, a pay-out driving means and a winding driving means, said tape cartridge replaceably placed in the case of the coating film transfer tool, said tape cartridge comprising:

a thin and flat support means having a geometric shape and dimensions sufficient for allowing accommodation in the case of the coating film transfer tool;

tape feeding means, provided on said thin and flat support means for paying out and feeding the coating film transfer tape; and tape collecting means, provided on said thin and flat support means for collecting the coating film transfer tape after use, wherein the tape feeding means and tape collecting means are constructed for detachable and interlocking engagement with the pay-out driving means and the winding driving means that are provided in the case of the coating film transfer tool, respectively.

2. A tape cartridge according to claim 1, wherein said support means being a positioning and holding means for positioning and holding said tape feeding means and tape collecting means only until they are in engagement with the driving means.

3. A tape cartridge for use in a coating film transfer tool, the coating film transfer tool for transferring a coating film disposed on a coating film transfer tape to a sheet surface and the like, the coating film transfer tool including a case, said tape cartridge, a payout rotation part, a winding rotation part, and a coating film transfer head attached to said case, said tape cartridge replaceably placed in the case of the coating film transfer tool, said tape cartridge comprising:

a thin and flat support base having a geometric shape and dimensions for allowing accommodation in the case of the coating film transfer tool;

a pay-out reel rotatably provided on said thin and flat support base, and having the coating film transfer tape wound thereabout; and a winding reel rotatably provided on said thin and flat support base for collecting the coating film transfer tape after use, wherein the reels are constructed such that they are detachably engaged and integrally rotatable with the pay-out rotation part and the winding rotation part, respectively provided rotatably in the case of the coating film transfer tool.

4. A tape cartridge for use with a coating film transfer tool according to claim 3, wherein said support base comprises a thin plate having a strength sufficient for holding the pay-out reel and the winding reel at a spacing corresponding to a spacing between the rotation parts, and said support base provides a guide surface for guiding one side of the coating film transfer tape during running thereof.

5. A tape cartridge for use with a coating film transfer tool according to claim 3, wherein the pay-out reel having a drum part, the drum part having a support end which is rotatably supported by the support base, and the winding reel having a drum part, the drum part having a support end which is rotatably supported by the support base, and said winding reel having a free end provided with a tape guide flange.

6. A tape cartridge for use with a coating film transfer tool according to claim 5, wherein a free end of the drum part of the pay-out reel is an open end and the tape guide flange is provided at a free end of the drum part of the winding reel.

7. A tape cartridge for use with a coating film transfer tool according to claim 6, wherein a tape guide flange is detachably attached to the free end of the drum part of the pay-out reel.

8. A tape cartridge for use with a coating film transfer tool according to claim 3, wherein the support base is provided with a first guide pin for guiding the coating film transfer tape that is paid out of the pay-out reel, and a second guide pin for guiding the coating film transfer tape that is wound up on the winding reel.

9. A tape cartridge for use with a coating film transfer tool according to claim 8, further comprising a guide roller, for rotationally guiding the coating film transfer tape, said guide roller is freely rotatably supported at least by the second guide pin on the winding side.

10. A tape cartridge for use with a coating film transfer tool according to claim 3, wherein the support base is provided with a receiving part for receiving a guide pin which is provided in the case of the coating film transfer tool, said guide pin for guiding the coating film transfer tape.

11. A tape cartridge for use with a coating film transfer tool according to claim 3, further comprising a detachable stopper for stopping and holding the reels against rotation.

12. A tape cartridge for use with a coating film transfer tool according to claim 3, wherein a paid-out leading end of the coating film transfer tape comprises a film base without a coating film thereon, and said paid-out leading end has a length at least corresponding to a distance between the pay-out reel and the coating film transfer head of the coating film transfer tool.

13. A tape cartridge for use with a coating film transfer tool according to claim 3, wherein the coating film transfer tape has a release agent layer disposed on one side of a film base, a white corrective paint layer disposed over said release agent layer and a pressure sensitive adhesive layer disposed over the paint layer.

14. A tape cartridge for use with a coating film transfer tool according to claim 3, wherein the coating film transfer tape has an adhesive agent layer disposed on one side of a film base and a release agent layer interposed therebetween.

15. A tape cartridge according to claim 3, wherein said support base positions and holds said reels only until they are engaged with said rotation parts.

16. A coating film transfer tool comprising:

a case having a shape and dimensions for allowing operation by holding it with one hand;

a coating film transfer tape;

a pay-out rotation part rotatably provided in the case;

a winding rotation part rotatably provided in the case;

a coating film transfer head attached to the case and projection from a leading end of the case, said coating film transfer head for pressing said coating film transfer tape on said pay-out reel against a transfer area: and a tape cartridge including a support base in a form of a flat plate having a geometric shape and dimensions for allowing accommodation in the case, a pay-out reel and a winding reel detachably engaged, respectively, with the rotation parts for integral rotation therewith, wherein the pay-out reel is rotatably provided on the support base and is for paying out the coating film transfer tape that is wound thereabout, and wherein the winding reel is rotatably provided on the support base and is for collecting the coating film transfer tape after use, and wherein the coating film transfer tape which is paid out from the pay-out reel passes through a pressing part of the coating film transfer head, and is thereafter wound about the winding reel.

17. A coating film transfer tool according to claim 16, wherein the coating film transfer head is fixedly projected from a leading end of the case such that the pressing part in the leading end thereof guides the coating film transfer tape as it is unwound from the pay-out reel and wound up on the winding reel.

18. A coating film transfer tool according to claim 16, wherein the coating film transfer head is rotatably operated between a coating film transfer tape replacement position and an application position, and the pressing part in a leading end of the head is arranged such that it guides the coating film transfer tape as it passes from the pay-out reel to the winding reel in the coating film transfer tape replacement position, and guides the transfer tape as it generally faces against gripping surfaces on the case in the application position.

19. A coating film transfer tool according to claim 16, wherein the coating film transfer tape has a release agent layer disposed on one side of a film base, a white corrective paint layer formed over said release agent layer, and a pressure sensitive adhesive layer disposed on the side of said pain layer remote from said release agent layer.

20. A coating film transfer tool according to claim 16, wherein the coating film transfer tape has an adhesive layer disposed on one side of a film base and a release agent layer interposed therebetween.

21. A tape cartridge according to claim 16, wherein said support base positions and holds said reels only until they are engaged with said rotation parts.

* * * * *

UNITED STATES PATENT AND TRADEMARK OFFICE

CERTIFICATE OF CORRECTION

PATENT NO. : 5,785,437

DATED : July 28, 1998

INVENTOR(S) : Koyama et al.

It is certified that error appears in the above-identified patent and that said Letters Patent is hereby corrected as shown below:

Title page;
Item [30], delete "6-322458" insert therefor -- 6-332458 --

Signed and Sealed this

Twenty-second Day of September, 1998

*Attest:*

*Attesting Officer*

Bruce Lehman

BRUCE LEHMAN

*Commissioner of Patents and Trademarks*